US007040486B2

(12) United States Patent
Godshaw et al.

(10) Patent No.: US 7,040,486 B2
(45) **Date of Patent: *May 9, 2006**

(54) COSMETIC AND UTILITY KIT

(75) Inventors: Donald E. Godshaw, Evanston, IL (US); Andrezj Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/463,272

(22) Filed: Jun. 17, 2003

(65) Prior Publication Data

US 2003/0209462 A1 Nov. 13, 2003

Related U.S. Application Data

(63) Continuation-in-part of application No. 09/930,066, filed on Aug. 15, 2001, now Pat. No. 6,681,936.

(60) Provisional application No. 60/225,247, filed on Aug. 15, 2000.

(51) Int. Cl.

| | |
|---|---|
| ***B65D 71/00*** | (2006.01) |
| ***A45D 40/00*** | (2006.01) |
| ***A45D 27/22*** | (2006.01) |
| ***A45C 3/00*** | (2006.01) |

(52) U.S. Cl. ..... 206/581; 206/810; 132/312; 132/315; 190/113; 383/84

(58) Field of Classification Search ..... 206/581, 206/320, 279, 287.1, 289, 766, 316.2, 806, 206/810; 190/113, 9; 132/312, 315; 150/112, 150/114, 118; 383/4, 78, 84, 86, 98, 99
See application file for complete search history.

(56) References Cited

U.S. PATENT DOCUMENTS

| | | | | |
|---|---|---|---|---|
| 1,150,057 | A * | 8/1915 | O'Neill | 190/109 |
| 1,214,282 | A * | 1/1917 | Day | 206/581 |
| 1,255,537 | A * | 2/1918 | Keon | 132/315 |
| 3,777,862 | A * | 12/1973 | Zipper | 190/107 |
| 3,904,003 | A * | 9/1975 | Margerum | 190/11 |
| 5,967,270 | A * | 10/1999 | Shyr | 190/109 |

* cited by examiner

*Primary Examiner*—Mickey Yu
*Assistant Examiner*—J. Gregory Pickett
(74) *Attorney, Agent, or Firm*—Banner & Witcoff, Ltd.

(57) ABSTRACT

A cosmetic and utility kit includes a container formed with a back side, bottom side, front side and opposite lateral side and further includes an extension flap extending from the back side that folds over the bottom side, front side and top side to enclose contents within the container.

15 Claims, 4 Drawing Sheets

COSMETIC AND UTILITY KIT

CROSS REFERENCE TO RELATED APPLICATION

This is a continuation in part application of Ser. No. 09/930,066 filed Aug. 15, 2001, now U.S. Pat. No. 6,681,936, which is the utility application based upon Ser. No. 60/225,247 filed Aug. 15, 2000, for which priority is claimed.

BACKGROUND OF THE INVENTION

In a principal aspect, the present invention relates to a luggage item typically referred to as a cosmetic or utility kit.

Travelers often desire to have available a smaller item of luggage, often termed a kit, to carry personal items, toiletries and the like. Such a luggage item is typically larger than a woman's handbag, but small enough to be conveniently carried and stored under the seat of an airliner or in the overhead compartment of an airliner. It is desirable, however, that such a kit or bag include various compartments, pouches, and pockets for storing items separately in a safe and secure manner. Further, it is desirable to provide a mirror in such kits that can be conveniently accessed without interference with the contents of the kit, yet will be incorporated in a manner which enables the mirror to be protected from breaking.

Another desire in such a kit, or luggage item, is to provide means whereby the item can be conveniently hung from a hanger or the like without spilling the contents while enabling ease of access to the contents and use of the kit. Such objectives inspired the development of the present invention.

SUMMARY OF THE INVENTION

Briefly, the present invention comprises a cosmetic and utility kit, or item of luggage, which includes a generally rectangular or purse shaped container having an open top and which further includes an extension panel that wraps around the bottom and front side of the kit and fits over the open top of the kit where the extension panel is retained by means of a zipper or other fastening mechanism to enclose the contents of the kit. In the rectangular parallelepiped version of the invention, a top flap then folds over and covers the flexible extension panel. Hanging straps are attached to the top flap or to the backside of the kit, or to both the top flap and backside of the kit, to enable the kit to be hung in a convenient manner with the extension flap open downwardly to expose the contents of the kit. A mirror and tray are incorporated in the extension flap which folds over the top side of the kit. Separate end pouches are provided at the opposite ends or sides of the kit.

Thus, it is an object of the invention to provide a cosmetic and utility kit which includes multiple pockets for separately storing various items in a protected manner.

A further object of the invention is to provide a cosmetic and utility kit which includes a container formed by a bottom side, back side, front side and opposite, lateral side panels defining an open top and further including an extension panel which folds over the bottom, front and top sides to provide an enclosure for storage of items.

Another object of the invention is to provide a utility and cosmetic kit which incorporates a tray and mirror to enable use of the kit when partially opened.

Another object of the invention is to provide a utility and cosmetic kit which is easily transported, lightweight, made from flexible fabric or material and which further includes zipper accessible pouches.

A further object of the invention is to provide a purse shaped cosmetic kit having a downwardly folding panel which may be closed to form the storage purse and which, when opened, provides a shelf for grooming items and which may be hung from a door or wall hook.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
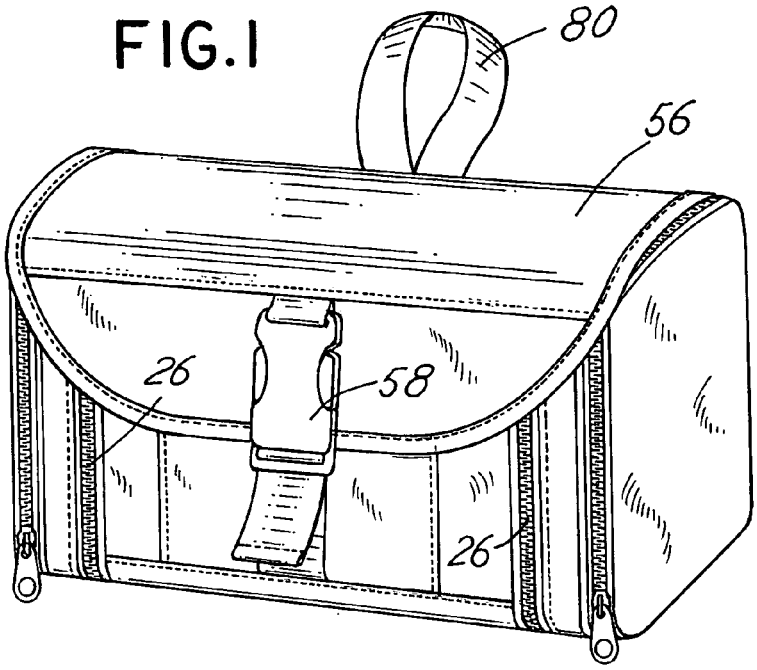
FIG. 1 is an isometric view of the kit viewed from the front side of the kit.

The cosmetic and utility kit of the present invention comprises a generally rectangular parallelepiped package, or container, which includes a back side 10, a front side 12 spaced from the back side 10, a first end panel 14, and a second end panel 16 parallel to and spaced from the first end panel 14. The first and second end panels 14 and 16 are connected to the back side 10 and to a bottom side 18. The bottom side 18 is connected to the back side 10 which is connected with the front side 12. The five sides 10, 12, 14, 16 and 18 are joined to form a parallelepiped enclosure with an open top side. The back side 10 includes an attached extension comprising an overlay bottom flap or extension 11, a front panel extension 13 and top pocket extension 15 that together define an elongate flexible extension panel 19 connected to lower edge 22 of the back side 10. In this fashion, the extension or flap 19 comprise the panels 11 and 13 and pocket 15. The flap 19 is foldable over the bottom side 18 and the front side 12 so that the pocket 15 fits over or into the open top of the defined by back side 10, front side 12, bottom side 18 and end sides or panels 14, 16. This elongate flap or extension 19 comprising panels 11, 13 and pocket 15 may be attached to the formed parallelepiped container by a single zipper 26. Thus, the extension flap 19 may be held in position and attached to the container formed by the back side 10, bottom side 18, front side 12, and end panels 14 and 16.

Figure 3:
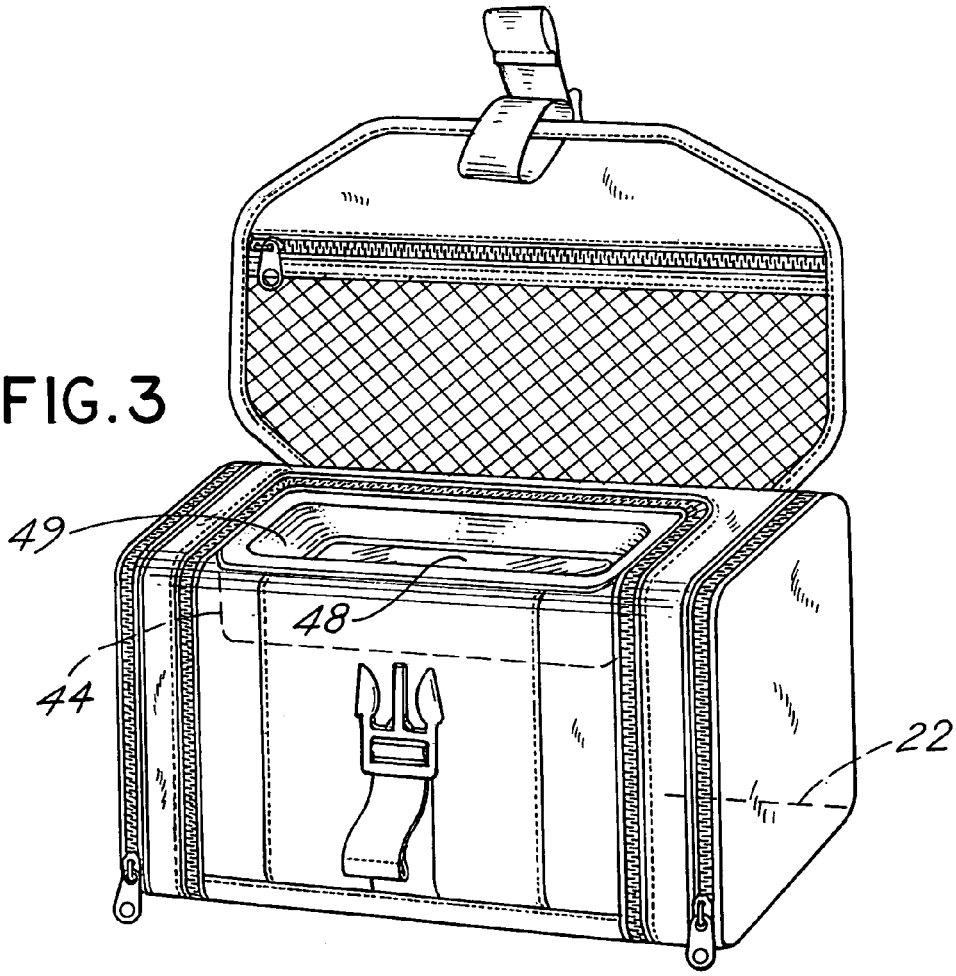
FIG. 3 is an isometric view of the kit of FIG. 2 in a partially opened position.

Various flexible mesh panels, such as mesh panel 30, may be provided to define pockets accessible through a zipper, for example, zipper 32 in the front panel 12. Similarly, mesh panel 40 on the inside of front covering panel extension 13 is accessed through a zipper opening 42 defining a pocket in the flap extension. The extension end or pocket 15 includes a zippered pouch 44 on the inside of the extension panel 15 accessible through a zippered opening 46. The zippered pouch 44 may, when folded back into the interior of the enclosure, include a mirror 48 on the outside face thereof, or may be contoured to form a tray 49, such as depicted in FIG. 3.

A top cover flap 56 is hinged to back side 10 and may be folded over the portion of extension 19 defined by the panel 13 and pocket 15. Flap 56 is attached to the outside of panel 13 by means of a strap or buckle 58 as shown in FIG. 1. The inside of the flap 56 includes a mesh pocket 60 with a zipper opening 62 for storage of additional items.

Pockets or pouches are also formed in association with each of the end panels 14 and 16. Thus, a pouch 66 is formed in combination with end panel 14 and access thereto is provided by a zipper 68. A pouch 70 accessible by a zipper 72 is associated with the end panel 16.

The interior of the enclosure defined by the sides or panels 10, 12 and 18 may include elastic restraining straps 74, for example, which will hold items, such as cosmetic items, within the enclosure. A mesh pocket formed by a mesh panel 76 may be provided within the pocket, such as pocket 66.

The kit further includes a hanging strap 80 which is attached to the back panel 10 at the juncture with the flap 56. Alternatively, the buckle 58 may comprise a hanging strap 81. Thus, both strap 80 and buckle 58 may be used or function to support or attach the kit to a hanger for easy access when traveling, by way of example.

Figure 2:
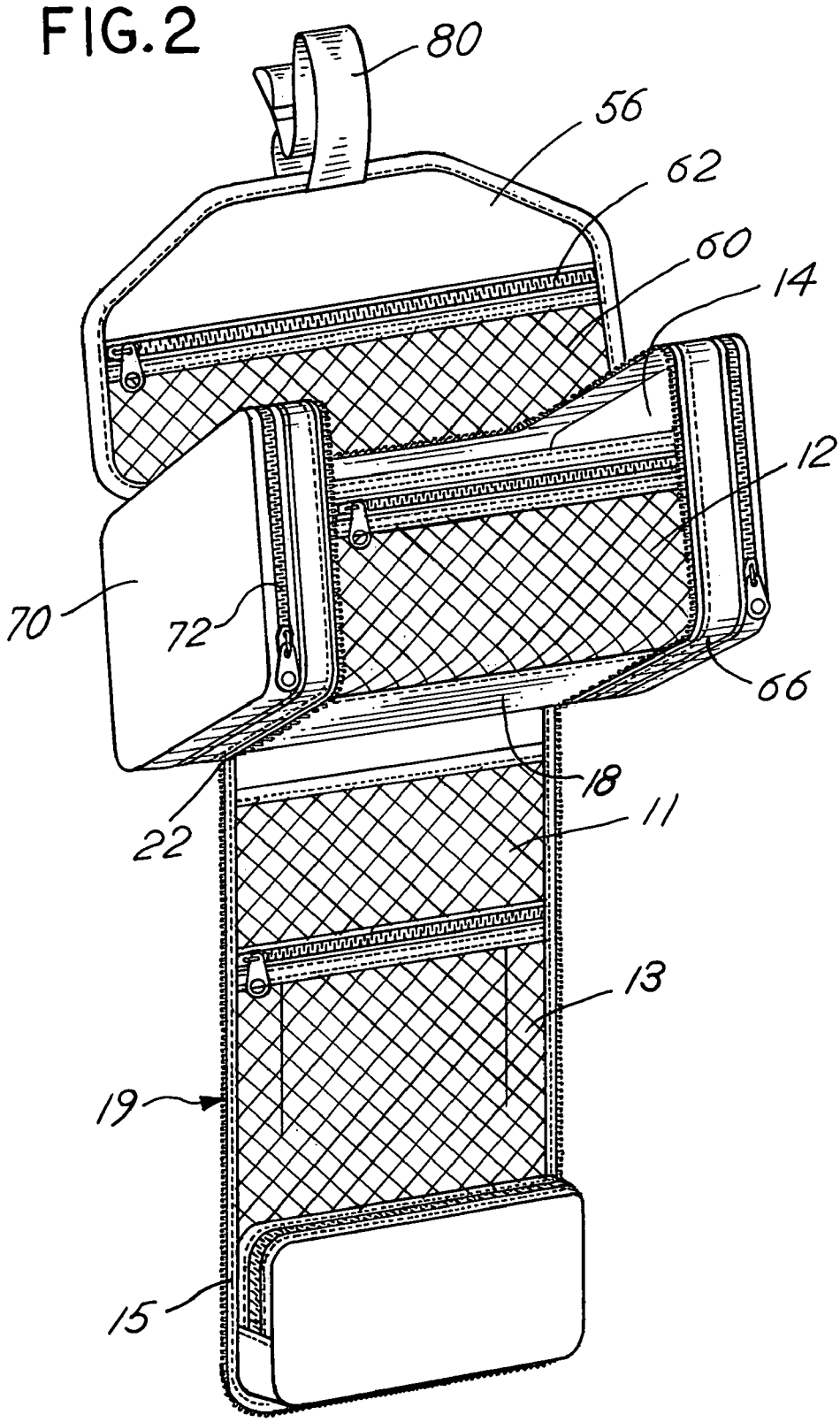
FIG. 2 is an isometric view of the kit of FIG. 1 in the open position.
Figure 4:
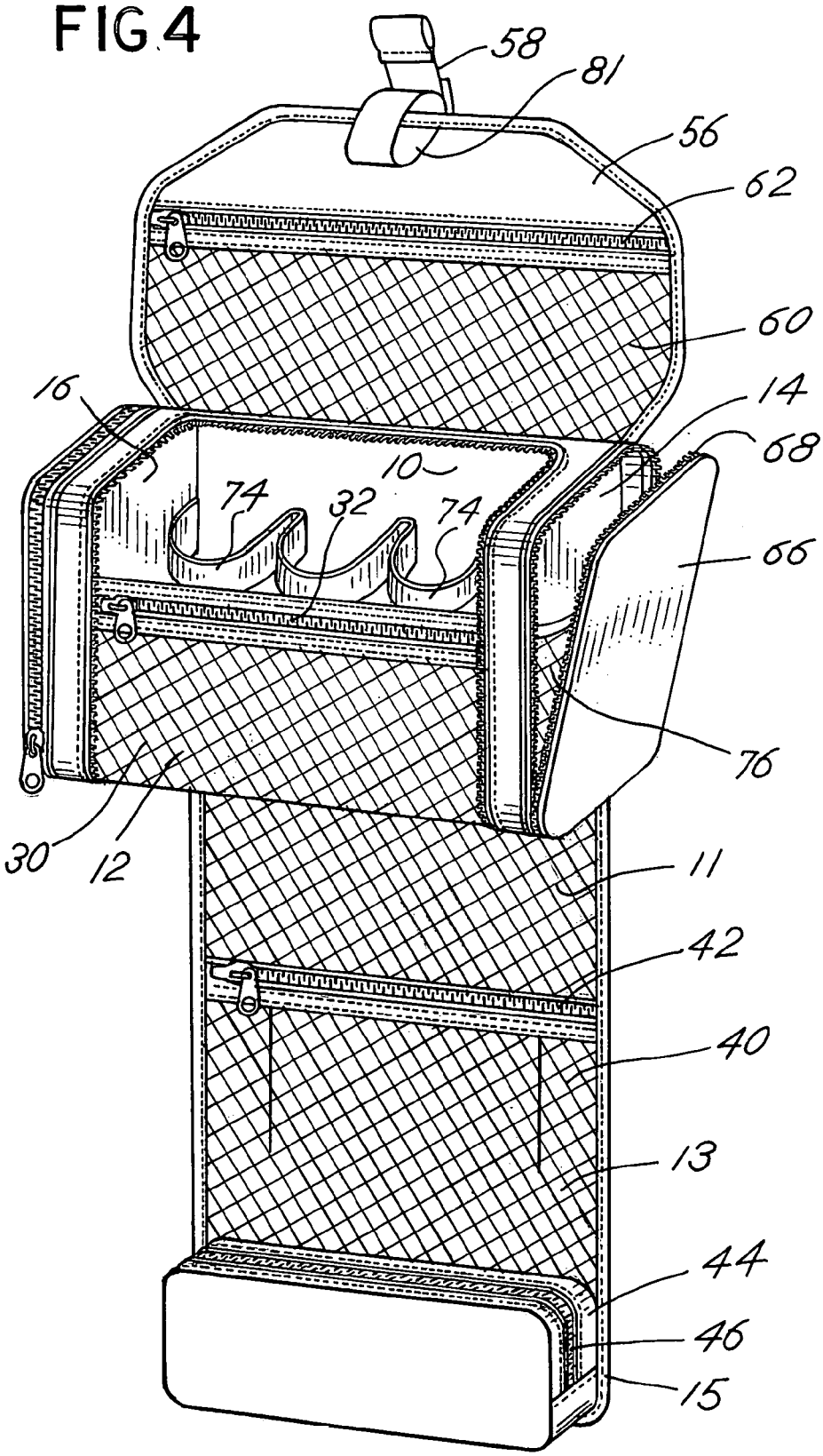
FIG. 4 is an isometric view of the kit of FIG. 2 wherein the interior of the kit is open and exposed for viewing.

One of the advantages of the kit is its utility in various circumstances. For example, as shown in the Figures, the zippers holding the extension flap or panel 19 may be fully opened and the kit may then be hung by the top flap 56 as shown in FIG. 2. In this manner, all of the contents of the kit may be easily accessed. The construction of the kit as described enables maintaining back side 10 and extension 19 as well as flap 56 flat against a wall or door or thereby permitting ease of access to the contents of the kit.

However, if an individual is sitting, for example, in an airline seat and wishes to utilize the kit, for example, to apply make-up, the kit may be partially opened as depicted in FIG. 3. That is, the top flap 56 may be lifted and disengaged from its buckle. A mirror 48 can then be utilized and the tray 49 also can be utilized to retain items on the top of the kit. The items will thus be placed at the edges of the mirror 48 so that the mirror 48 may be utilized while the tray 49 retains the items conveniently so that they will not be dropped or lost. The tray 49 may be a premolded item which is shallow and serves as the inside panel of the pocket item 15. The support strap 80 in FIG. 1 may be utilized to hold the kit or container attached to the back of the chair or the seat while the kit is in the partially opened condition, as illustrated in FIG. 3 again, enabling use of the kit by virtue of partial opening of the top flap 56.

Figure 5:
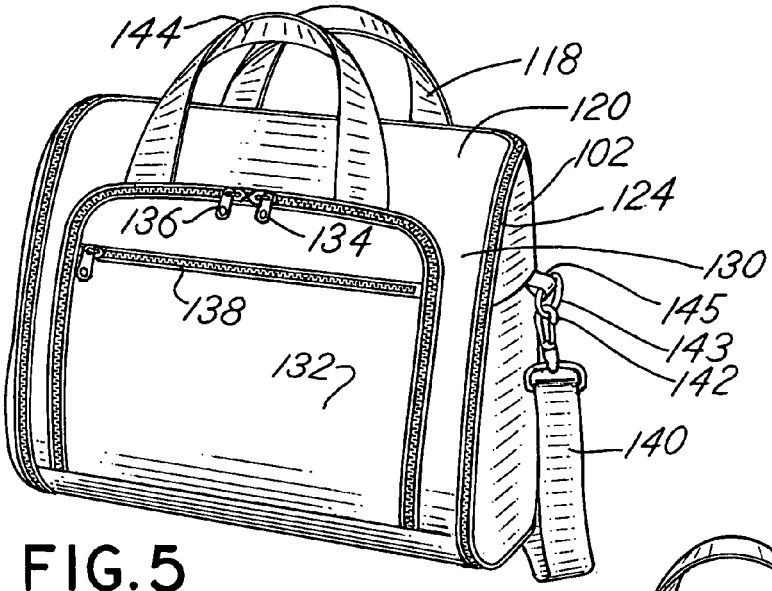
FIG. 5 is an isometric view of an alternative embodiment in the form of a closed purse.
Figure 6:
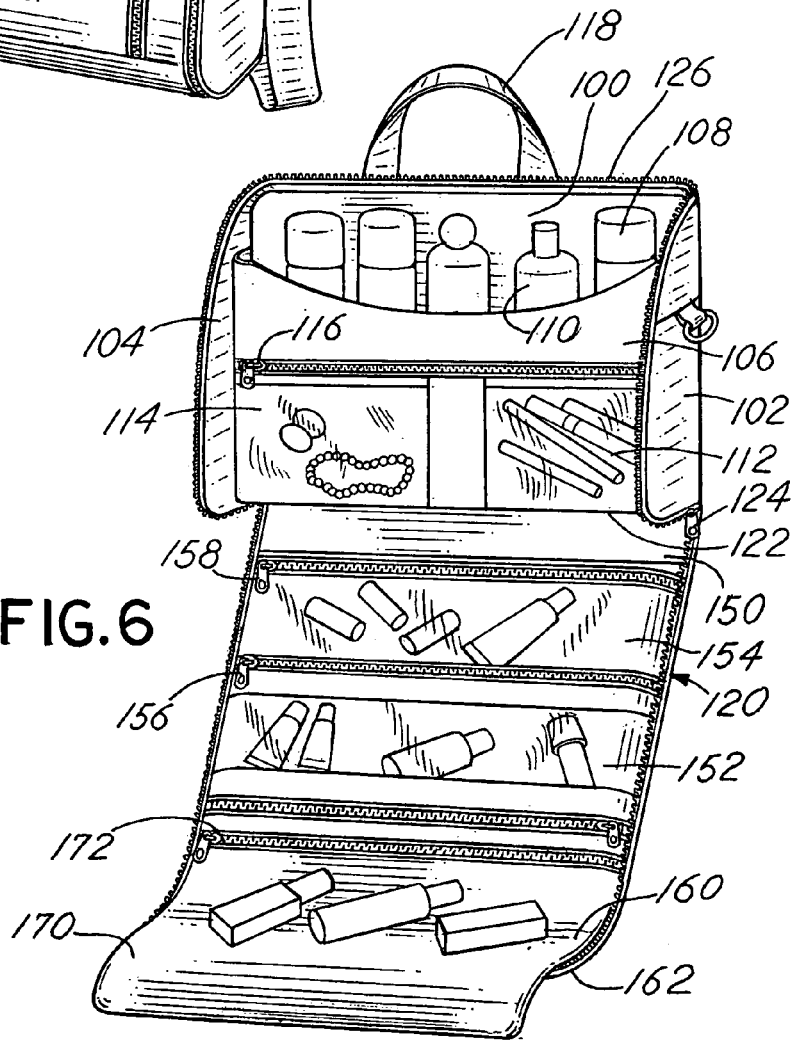
FIG. 6 is an isometric view of the embodiment of FIG. 5 with the kit in the open position suspended on a door or wall hook.

FIGS. 5 and 6 illustrate a second embodiment of the invention. In the embodiment of FIGS. 5 and 6, the subject matter of the invention is incorporated in a conventional purse shaped container. More specifically, the container includes a back side or panel 100 and opposite end or side panels 102 and 104 which are joined to the back panel 100. The side panels 102 and 104 are generally parallel to one another and spaced from one another and, in combination with a front panel 106 along with back panel 100, define an enclosure for toiletries, cosmetics and other items such as those items depicted in FIG. 6 retained in bottles 108 and 110. The front panel 106 further includes a series of pockets attached to the panel such as pocket 112 and pocket 114 which are accessible through the top side thereof by means of a zipper fastening means 116. The back panel 100 further includes a carrying strap 118 attached to the top edge 126 thereof. The carrying strap 118 may serve as a means for attachment and support on a hook or door or such other item as may be utilized for hanging of the kit.

The kit further includes a flap extension 120 extending from the back panel 100 and, in effect, comprising an elongate extension of the back panel 100. The extension or flap 120 is sized and configured so that it will fit over the underside or bottom side 122 of the purse like enclosure defined by the back side 100, opposite end sides 102 and 104 and the front side 106. Thus, the flap 120 folds over the bottom side 122 as well as the front side 106. The extension flap 120 includes a peripheral zipper fastening means 124. The peripheral fastening means 124 effects attachment of the flap extension 120 to the opposite lateral side of the bottom panel 122 as well as the outer edges of the end panels 102 and 104 and also to the top edge 126 of the back panel 100. Closing of the zipper connection or fastening means 124 will thus effect closure of the kit to the form depicted in FIG. 5.

There is optionally provided and preferably provided on the outside face 130 of the back panel extension 120 an auxiliary pocket 132 which is accessible through zipper or fastening means 134 and 136 to the interior of the pocket 132. A further zipper or fastening means 138 is provided for access to yet a further pocket incorporated in the front pocket 132.

A carrying strap 140 is attached by a buckle 142 to one of the end panels 102. A carabiner 143 attachment effects attachment of the opposite end of strap 140 to a loop 145 sewn into the end panel 104. Thus, the kit may be carried over the shoulder in a fashion of a purse by the strap 140 which is attached at its opposite ends to the bag.

A second hand strap 144 substantially with the same shape and dimension as the strap 118 is attached to the front panel extension 120 and more particularly to the outside face 130 thereof. Closure of the panel flap extension 120 thus encloses the contents stored within the container defined by the various panel sides 100, 102, 104, 106 and 122 as well as materials contained within the pockets on the inside face 150 of the panel extension 120. That is, the panel extension 120 include a series of pockets 152 and 154 accessible by means of a zipper fastening means 156 and 158, respectively on the inside face 150 of the extension flap 120.

A further feature of the invention is the provision of a generally outwardly extending semi-rigid or rigid storage panel or support shelf 160 at the outer end of the extension flap 120. By incorporating a molded plastic or formed board or shell 160 within the end of the extension flap 120, or by utilizing wire supports at the outer end 162 of the extension flap 120, a support shelf 160 is provided for support of cosmetics and other items when the kit is opened as depicted in FIG. 6.

When being transported and moved from place to place, then the kit is in the form depicted in FIG. 5 and has the general configuration of a purse. From a functional viewpoint, the embodiment of FIGS. 5 and 6 is very similar to that of FIGS. 1–4. However, the configuration or shape of the container is altered to a more purse-like configuration.

When the purse-like configuration or kit of FIG. 5 is opened as depicted in FIG. 6 and hung by a strap 118 from a hook on a door, for example, the back side 100, as well as the panel extension 120, fits flat against the door and both are supported thereby providing for easy access by the user of the kit. The shelf or outwardly extending section 160 supports cosmetics and other items when the kit is hung in a form depicted in FIG. 6 thereby facilitating the functionality of the kit.

It is possible to incorporate a mirror, for example, in place of or as part of one of the pockets 112 or 114 or in one of the pockets 154. The shelf 160 which projects outwardly from the extension flap 120 may include a flexible pocket 170 supported thereby having a zipper access fastening means 172. Thus, items may be stored within the pocket 170 and the entire assembly folded over for storage in the form depicted in FIG. 5.

Various modifications may be made to the kit or luggage item. The pockets may be formed of mesh or fabric material. Zippers may be included or excluded. The end pouches may be included or excluded. The shape and form of the tray may be adjusted or altered. A mirror may be incorporated on the inside of the flap 56 and protected by padding, for example. Thus, the invention is to be limited only by the following claims and equivalents thereof.

What is claimed is:

1. A cosmetic and utility kit comprising, in combination:

a generally rectangular, parallelepiped container having a bottom side, a back side with an upper edge and a lower edge, a front side spaced from the back side, a first end panel, a second end panel spaced from the first end panel, said first and second end panels connected to the back side, bottom side and front side to form a storage enclosure with an open top, a first elongate, extension panel of flexible material connected to the lower edge of the back side, said extension panel defining a flap foldable over the bottom side, the front side and the open top of the enclosure, and an elongate top flap extension panel of flexible material connected to the upper edge of the back side and foldable over the open top and a part of the first extension panel extending over the front side, said top flap extension panel connectable to the first extension panel to retain the first extension panel folded over the front side and open top;

said first extension panel including a peripheral fastener for attaching the peripheral edge of the first extension panel to the bottom side, front side and over the open top.

2. The kit of claim 1 wherein the first extension panel includes an inside face and an outside face, and further including a pocket on the inside face positioned to fit in the open top of the enclosure when the first extension panel is folded over the open top.

3. The kit of claim 1 wherein the said first extension panel including a peripheral fastener for attaching the peripheral edges of the first extension panel to the bottom side, front side and over the open top.

4. The kit of claim 1 wherein the top flap extension panel includes an attachment member for supporting the top extension panel from a support member.

5. The kit of claim 1 including a storage pocket fitted on at least one of the first and second end panels.

6. The kit of claim 1 including a storage pocket fitted on each of the first and second end panels.

7. The kit of claim 1 wherein the first extension panel includes an inside face and an outside face, and further including a plurality of storage pockets on the inside face.

8. The kit of claim 1 wherein the top flap extension panel includes an inside face and an outside face, and further including a storage pocket on the inside face.

9. The kit of claim 1 wherein the front side includes a storage pocket.

10. The kit of claim 1 including a hanger member attached to the upper edge of the back side.

11. A cosmetic and utility kit comprising, in combination:

a container of flexible material including:

an outer layer of said material defining a back side with a lower edge;

a bottom side;

a front side;

said backside, bottom side and front side joined by first and second spaced end sides that in combination form an enclosure having an open top side, said open top side and said bottom side having a substantially congruent configuration;

a supplementary exterior flap of flexible material extending from and attached to the back side lower edge to form a generally planar member which is foldable over the bottom side, front side and top side to enclose the container; and a releasable peripheral fastener for attaching the peripheral edge of the exterior flap to the bottom side, first end side and second end side of the container to enclose the container.

12. The kit of claim 11 further including a hanger attached to the back side for supporting the kit on a planar surface.

13. The kit of claim 11 or claim 12 wherein the extension flap includes an inside face and an outside face with storage pockets incorporated on at least one face.

14. The kit of claim 11 or claim 12 including a zipper for releaseably attaching the exterior flap to the container to fully enclose the container.

15. A cosmetic and utility kit comprising, in combination:

a generally rectangular, parallelepiped container having a bottom side, a back side with an upper edge and a lower edge, a front side spaced from the back side, a first end panel, a second end panel spaced from the first end panel, said first and second end panels connected to the back side, bottom side and front side to form a storage enclosure with an open top, an elongate, flexible extension panel connected to the lower edge of the back side, said extension panel foldable over the bottom side, the front side and the open top of the enclosure and attachable to the bottom panel and end panels to form an enclosed container, a top flap of flexible material connected to the upper edge of the back side and foldable over a part of the extension panel covering the open top and front side, said top flap including a connection element for attachment to a part of the extension panel covering the front side; and a peripheral fastener on periphery of the extension panel for attaching the extension panel to the bottom panel and end panels.

* * * * *